US006494678B1

(12) United States Patent
Bunker

(10) Patent No.: US 6,494,678 B1
(45) Date of Patent: Dec. 17, 2002

(54) FILM COOLED BLADE TIP

(75) Inventor: Ronald Scott Bunker, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/681,744

(22) Filed: May 31, 2001

(51) Int. Cl.[7] ..... F01D 5/18
(52) U.S. Cl. ..... 416/97 R; 415/115
(58) Field of Search ..... 416/97 R, 97 A, 416/228, 236 R; 415/115

(56) References Cited

U.S. PATENT DOCUMENTS

| | | | | |
|---|---|---|---|---|
| 5,660,523 | A | | 8/1908 | Lee |
| 4,606,701 | A | | 8/1986 | McClay et al. |
| 4,761,116 | A | | 8/1988 | Braddy et al. |
| 4,893,987 | A | | 1/1990 | Lee et al. |
| H903 | H | | 4/1991 | Weinstein |
| 5,183,385 | A | | 2/1993 | Lee et al. |
| 5,282,721 | A | * | 2/1994 | Kildea ..... 416/97 R |

OTHER PUBLICATIONS

Rotor–Tip Leakage: Part 1, Basic Methodology, TC Booth, PR Dodge. HK Hepworth, Transactions of the ASME, vol. 104, Jan. 1982, pp. 154–161.

* cited by examiner

*Primary Examiner*—Edward K. Look
*Assistant Examiner*—Kimya N McCoy
(74) *Attorney, Agent, or Firm*—Patrick K. Patnode; Christian G. Cabou

(57) ABSTRACT

A turbine assembly having at least one rotor blade comprises an airfoil having a pressure sidewall, a suction sidewall and a tip portion having a tip cap. A tip is disposed on the tip cap. A plurality of blade tip cooling holes are positioned within the airfoil near the tip portion. Cooling grooves are disposed within the airfoil to connect the blade tip cooling holes with the top portion of the tip to transition cooling flow from the cooling holes to the tip portion.

36 Claims, 4 Drawing Sheets

FILM COOLED BLADE TIP

BACKGROUND OF INVENTION

The present invention relates generally to turbine engine blades and, more particularly, to a turbine blade tip peripheral end wall with a grooved cooling arrangement.

A reduction in turbine engine efficiency results from leaking of hot expanding combustion gases in the turbine across a gap between rotating turbine blades and stationary seals or shrouds which surround the blades. The problem of sealing between such relatively rotating members to avoid loss in efficiency is very difficult in the turbine section of the engine because of high temperatures and centrifugal loads.

One method of improving the sealing between a respective turbine blade and shroud is the provision of squealer type tips on turbine blades. A squealer tip includes a continuous peripheral end wall of relatively small height typically surrounding and projecting outwardly from an end cap on the outer end of a turbine blade that encloses a cooling air plenum in the interior of the blade.

During operation of the engine, temperature changes create differential rates of thermal expansion and contraction on the blade rotor and shroud that may result in rubbing between the blade tips and shrouds. Centrifugal forces acting on the blades and structural forces acting on the shrouds create distortions thereon that may also result in rubbing interference.

Such rubbing interference between the rotating blade tips and surrounding stationary shrouds causes heating of the blade tips resulting in excessive wear or damage to the blade tips and shrouds. Heating produced by the leakage flow of hot gases may actually be augmented by the presence of a cavity defined by the end cap and peripheral end wall of the squealer tip because of the increased surface area of the peripheral end wall. The peripheral end wall is especially difficult to cool, because the end wall extends away from the internally cooled region of the blade. Therefore, squealer type blade tips, though fostering improved sealing, actually require additional cooling.

Because of the complexity and relative high cost of replacing or repairing turbine blades, it is desirable to prolong as much as possible the life of blade tips and respective blades. Blade tip cooling is a conventional practice employed for achieving that objective. The provision of holes for directing air flow to cool blade tips is known in the prior art, for instance as disclosed in U.S. Pat. No. 4,247,254 to Zelahy, and have been applied to squealer type blade tips as disclosed in U.S. Pat. No. 4,540,339 to Horvath.

Turbine engine blade designers and engineers are constantly striving to develop more efficient ways of cooling the tips of the turbine blades to prolong turbine blade life and reduce engine operating cost. Cooling air used to accomplish this is expensive in terms of overall fuel consumption. Thus, more effective and efficient use of available cooling air in carrying out cooling of turbine blade tips is desirable not only to prolong turbine blade life but also to improve the efficiency of the engine as well, thereby again lowering engine operating cost. Consequently, there is a continuing need for a cooling hole design that will make more effective and efficient use of available cooling air.

SUMMARY OF INVENTION

A turbine assembly having at least one rotor blade comprises an airfoil having a pressure sidewall, a suction sidewall, and a tip portion having a tip cap. A squealer tip is disposed on the tip cap. A plurality of blade tip cooling holes are positioned within the airfoil near the tip portion. Cooling grooves are disposed within the airfoil to connect the blade tip cooling holes with the top portion of the squealer tip to transition cooling flow from the cooling holes to the tip portion.

DETAILED DESCRIPTION

Figure 1:
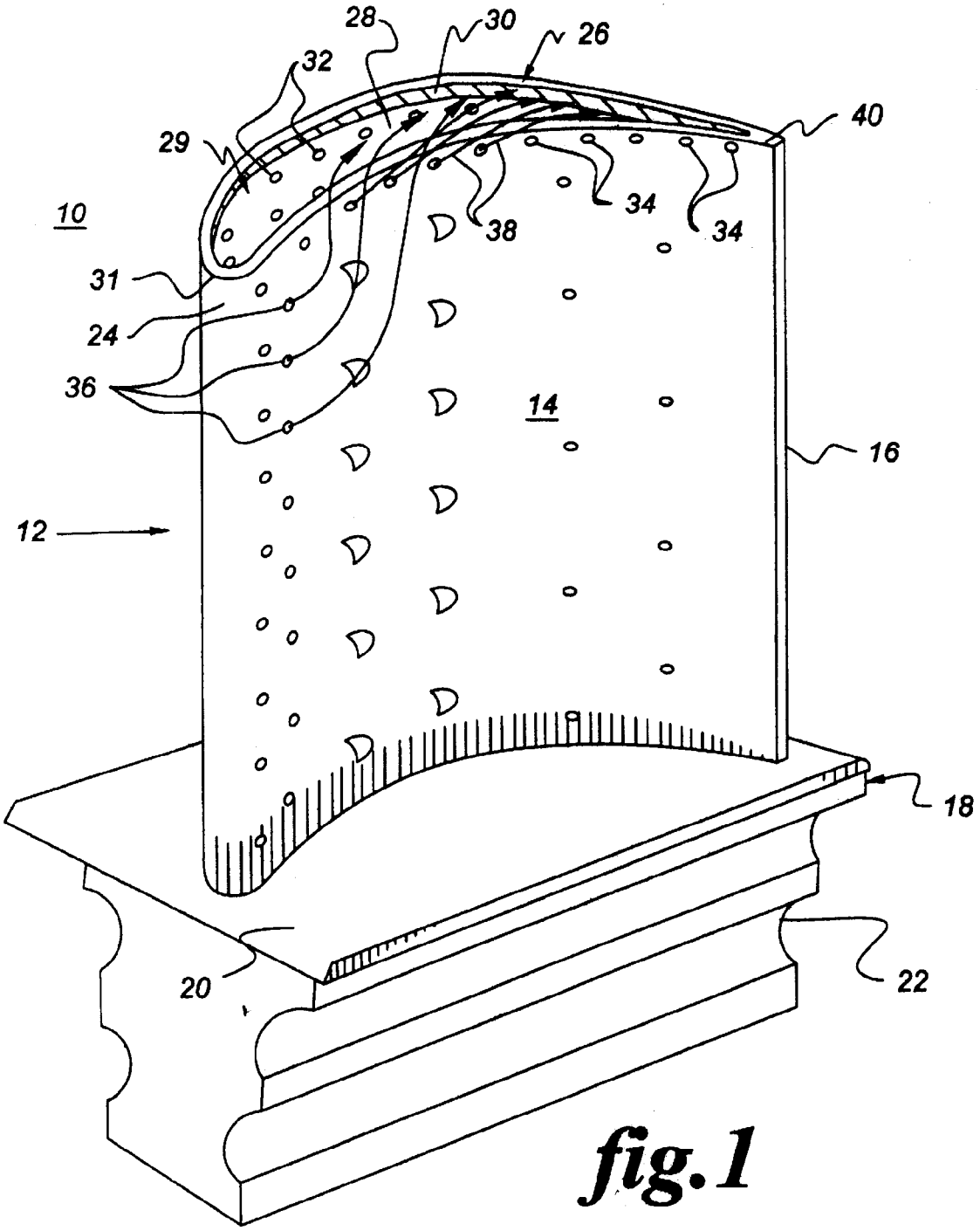
fig. 1 PRIOR ART
FIG. 1 is a perspective view of a turbine blade having a squealer tip with cooling holes through an end cap of the blade.

A turbine blade 10 includes an airfoil 12 having a pressure side 14, a suction side 16, and a base 18 for mounting airfoil 12 to a rotor (not shown) of an engine (not shown) as shown in FIG. 1. Base 18 has a platform 20 for rigidly mounting airfoil 12 and a dovetail root 22 for attaching blade 10 to the rotor.

An outer end portion 24 of blade 10 has a tip 26. Tip 26 includes an end cap 28 which closes outer end portion 24 of blade 10, and an end wall 30 attached to, and extending along the periphery 31 of, and projecting outwardly from, end cap 28 so as to define a cavity 29 therewith. End cap 28 of tip 26 typically is provided with an arrangement of tip cooling holes 32 formed therethrough for permitting passage of cooling air flow from the interior of blade 10 through end cap 28 to cavity 29 for purposes of cooling blade tip 26.

The tip of a turbine blade is designed to serve many purposes. One purpose is to maintain the blade integrity in the event of rubbing between the blade tip and a stationary shroud (not shown). A second purpose is to minimize the leakage flow across the blade tip from the pressure side to the suction side and a third purpose is to cool the blade tip within the material limit. Tip 26 provides the rubbing capability and also serves as a two-tooth seal to discourage the leakage flow.

As shown in FIG. 1, at least one and typically a plurality of blade tip film cooling holes 34 are disposed within outer end portion 24 of airfoil 12. Typically, blade tip film cooling holes 34 provide external film cooling issued on the blade tip pressure side 14 in the radial direction. Some designs use as many film holes 34 as possible, in the limited space available, in an effort to flood the pressures side tip region with coolant. It is desired that this film cooling then carry over onto end wall 30 and into cavity 29 to provide cooling there and also over the suction side surfaces of tip 26. Film holes 34 are oriented in the radially outward direction because the prevailing mainstream gas flows tend to migrate in this manner in the tip region. In practice, it is still very difficult and very inconsistent to cool the blade tip in this manner due to the very complex nature of the cooling flow as it mixes with very dynamic hot gases of the mainstream flow. Blade tip film cooling holes 34 are typically angled with respect to the surface of airfoil 12. In one embodiment, blade tip cooling holes are angled in the range between about 20 to about 70 with respect to the surface of airfoil 12.

As shown in FIG. 1, hot air flows (generally illustrated as arrows 36) over airfoil 12 and exerts motive forces upon the outer surfaces of airfoil 12, in turn driving the turbine and generating power. In some arrangements, cooling flow (generally illustrated by arrows 38) exits film holes 34 and is swept by hot air flow 36 towards a trailing edge 40 of airfoil 12 and away from tip cap 28. Typically, this results in a mixed effect, where some of the cooling air is caught up and mixed with the hot gases and some goes onto tip cap 28 and some goes axially along the airfoil to trailing edge 40. This results in inadequate cooling of tip cap 28 and endwall 30 and eventual temperature inflicted degradation of tip cap 28 and endwall 30.

Figure 2:
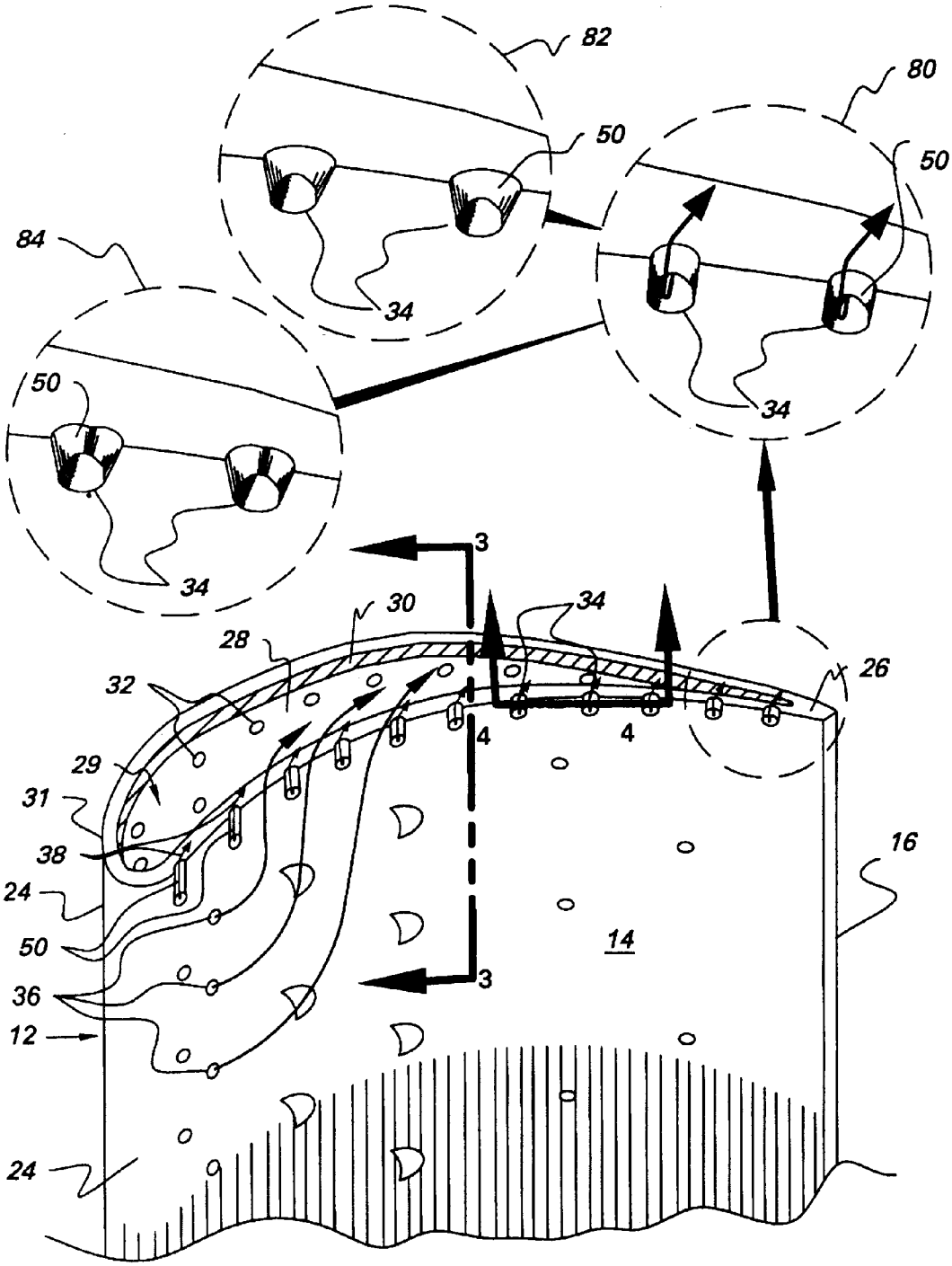
FIG. 2 is a perspective view of a turbine blade having a squealer tip and incorporating the cooling arrangement in accordance with the present invention.

As shown in FIG. 2, hot air flow 36 passes over airfoil 12 and exerts motive forces upon the outer surfaces of airfoil 12, driving the turbine and generating power. In accordance with one embodiment of the instant invention, at least one and typically a plurality of grooves 50 are disposed within outer portion of airfoil 12 connecting at least one corresponding blade tip film cooling hole 34 with top portion of the airfoil to transition cooling flow 38 from blade tip film cooling holes 34 to tip cap 28 and to end wall 30.

As shown, in an exploded view of FIG. 2, cooling grooves 50 can be disposed so as to have a substantially constant width from film cooling holes 34 to tip cap 28, as indicated by reference numeral 80. Alternatively, a fan-type cooling groove 50 can be utilized to spread the cooling air 30 as it exits film cooling holes 34, as indicated by reference numeral 82. Also, a multiple-channel cooling groove 50 can be utilized, as indicated by reference numeral 84.

Figure 3:
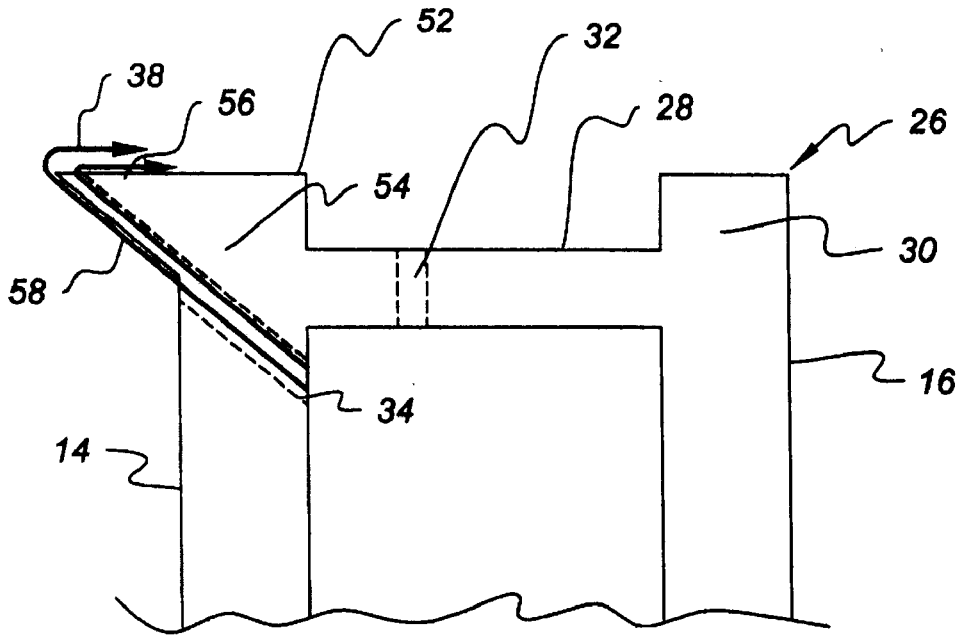
FIGS. 3–7 are fragmentary radial sectional views of the turbine blade of FIG. 2 taken along line 3—3.

In one embodiment, airfoil 12 further comprises a pressure side winglet 54 disposed upon an upper portion of airfoil 12, as best shown in FIG. 3. Pressure side winglet 54 includes a top portion 56 contiguous with top surface 52 of tip 26 and an angled body portion 58.

Angled body portion 58 is typically angled at the same angle as film cooling hole 34 in reference to the surface of airfoil 12. In one embodiment, angled body portion 58 is positioned coextensively with a top portion of a respective film cooling hole 34 such that the top portion of film cooling hole 34 and angled body portion 58 generally form a straight line. In one embodiment, groove 50 is disposed directly into a respective angled body portion 58 such that cooling flow issuing from a respective cooling hole 34 flows through groove 50 to top portion 56 of pressure side winglet 54 over top surface 52 of tip 26 and on to tip cap 28.

As shown in FIG. 3, the addition of a pressure side tip winglet 54, or angled projection of tip surface, performs the function of adding resistance to the flow of gases into the gap between the blade tip and the stationary shroud. Such a winglet 54 is known to reduce hot gas leakage flows into the blade tip gap. With the added requirement of film cooling for the blade tip, these two functions can be combined in novel ways to synergistically improve performance and extend blade life. Blade tip film holes 34 are here provided with substantially the same angle as winglet 54. Winglet 54 in this embodiment is a straight surface with a sharp corner at the coincidence of surfaces 56 and 58. The film holes are thus issued tangentially onto the surface with a 0-degree relative angle, which drastically limits the ability of the hot gases to get under the film layer or film jets. It is a well established effect, that tangential film cooling on a surface is more efficient than film cooling issued at an angle. This increase in cooling efficiency can be very large, as much as doubling or even tripling the film cooling effectiveness locally. The relative angle between winglet 54 and film holes 34 need not be exactly 0 degrees, but can vary from −15 to +15 degrees, typically, and still achieve the desired effect. Furthermore, in this embodiment, film holes 34 are discharged into grooves 50 in winglet 54, which grooves 50 are at the same angle as winglet 54. Grooves 50 may be of various depths and shapes. Grooves 50 serve to contain the film cooling and further protect it from mixing with the hot gases. Grooves 50, or channels, also serve to increase the external surface area covered by the film cooling. Grooves 50 may be cast features in the blade tip, or machined after casting, or even simply formed by laser drilling as part of the process of forming the film holes themselves. Grooves 50 need not be of constant cross section, but could also flare out in size with distance from the film hole, which can provide added benefit in performance. The groove depth into the surface can vary; this is not restricted by the dimension of the film hole. Two or more grooves 50 may proceed from a single film hole to help spread the cooling while also protecting the coolant from mixing with hot gases.

Figure 4:
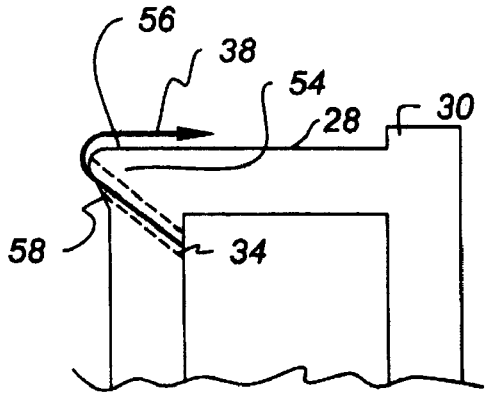

As shown in FIG. 4, winglet 54 edge defined by the coincidence of surfaces 56 and 58 need not be sharp, but can be rounded. This in fact will allow the cooling air to negotiate the turn onto the tip cap region better. This figure also shows an embodiment which may be used in connection with the present invention, namely that the squealer tip perimeter rim need not extend completely around the pressure side and suction side of the tip; ie. need not form a tip cavity. In this embodiment, the blade tip 26 has a single-tooth squealer located only along the suction side. The winglet 54 and novel tip film cooling may still be employed on the pressure side.

Figure 5:
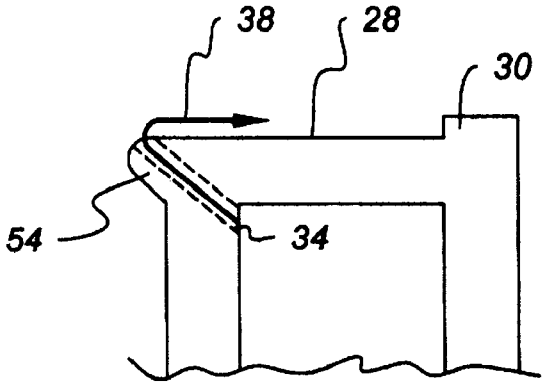

As shown in FIG. 5, film cooling holes 34 can be entirely contained within winglet 54, rather than being discharged near the base of winglet 54. By routing the film holes within the winglet 54, these cooling holes cease to be film cooling holes, but instead become internal cooling for the winglet 54. Given a suitably thin amount of material between the cooling hole and the external surface of the winglet 54, this can result in very efficient cooling of the winglet 54. This embodiment in essence provides a total shield to the film holes, preventing any mixing with the hot gases on the pressure side of the blade tip.

Figure 6:
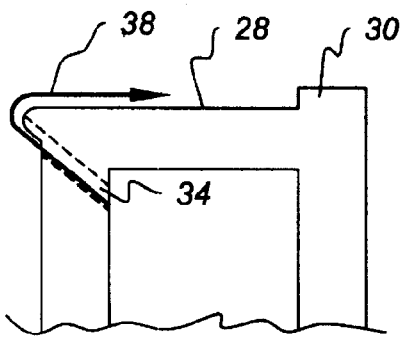

As shown in FIG. 6, this embodiment is a combination of FIGS. 4 and 5, in which the film cooling holes 34 are not entirely contained within the winglet 54.

Figure 7:
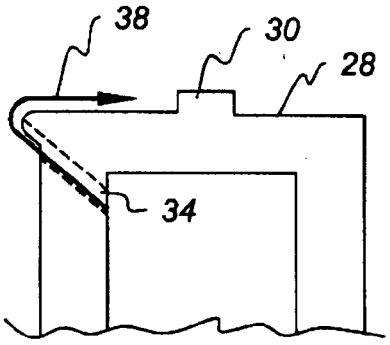

As shown in FIG. 7, this embodiment is the same as that of FIG. 4, but with another single-tooth seal location. This figure shows an embodiment which may be used in connection with the present invention, namely that the tip perimeter rim need not extend completely around the pressure side and suction side of the tip; ie. need not form a tip cavity. In this embodiment, the blade tip has a single-tooth squealer located along or approximately along the mean chordline of the blade tip section. The winglet 54 and novel tip film cooling may still be employed on the pressure side.

Figure 8:
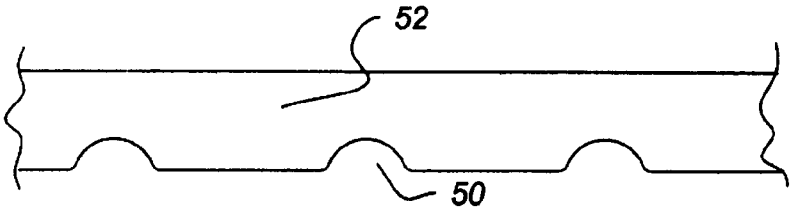
FIGS. 8–10 are fragmentary longitudinal sectional views of the turbine blade of FIG. 2 taken along line 4—4.
Figure 9:
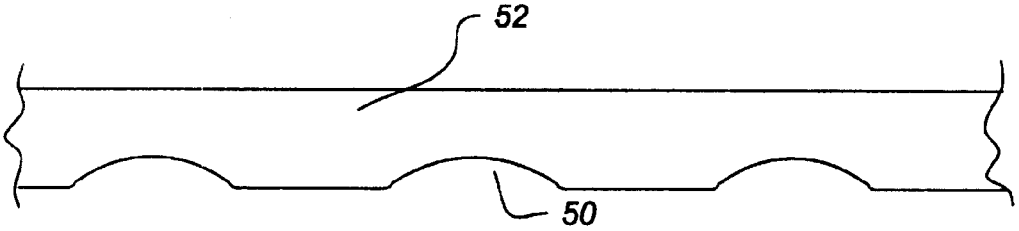
Figure 10:
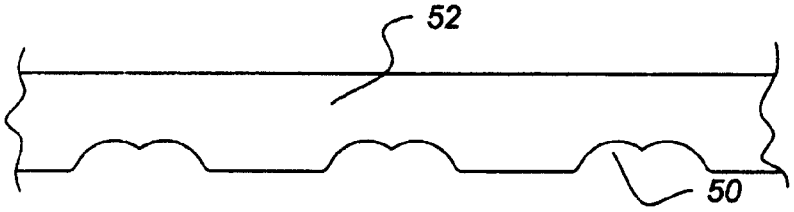

These figures depict examples of the shaping which the film hole grooves 50 may assume. In FIG. 8, grooves 50 are made to be cylindrical in shape, and can be either the same diameter as the film hole or larger in diameter. A larger diameter will provide additional coolant spreading and surface area for cooling. In FIG. 9, grooves 50 are flared or fan-shaped diffusers from the film hole exit to the tip surface 52. The degree of flare may be altered continuously or abruptly. In FIG. 10, grooves 50 are formed with two branches both emanating from the film hole exit. The branches may be cylindrical or flared, and may be from 0 to 45 degrees in included angle.

As cooling air 38 exits blade tip film cooling holes 34, cooling air 38 flows into groove 50 and travels to a top surface 52 of tip 26 and flows into tip cap 28 to provide cooling thereto as best shown in FIGS. 3 and 4. Grooves 50 provide a safe passage for cooling flow 38 issuing from film cooling holes 34 resulting in appropriate cooling of the tip cap 28 region, lessening end cap degradation.

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

What is claimed is:

1. A turbine assembly comprising:

at least one rotor blade comprising an airfoil having a pressure sidewall and a suction sidewall defining an outer periphery and a tip portion having a tip cap;

a plurality of blade tip cooling holes disposed within at least one of said pressure sidewall and said suction sidewall of said airfoil adjacent to said tip portion; and at least one cooling groove disposed within at least one of said pressure sidewall and said suction sidewall of said airfoil connecting at least one of said blade tip cooling holes with a top portion of said tip portion so as to transition cooling flow from said cooling holes to said tip portion;

wherein said grooves are multiple-channel cooling grooves.

2. A turbine assembly in accordance with claim 1, wherein said blade tip film cooling holes are angled with respect to said airfoil.

3. A turbine assembly in accordance with claim 1, wherein said blade tip film cooling holes are angled in the range between about 20° to about 70° with respect to the surface of said airfoil.

4. A turbine assembly in accordance with claim 1, wherein said cooling grooves are disposed so as to have a substantially constant width from said film cooling holes to said tip portion.

5. A turbine assembly in accordance with claim 1, wherein said grooves are fan-type cooling grooves.

6. A turbine assembly in accordance with claim 1, further comprising a pressure side winglet disposed upon an upper portion of said airfoil, said winglet having a top portion contiguous with said top portion of said tip and an angled body portion.

7. A turbine assembly in accordance with claim 6, wherein said angled body portion is angled at substantially the same angle as said film cooling holes.

8. A turbine assembly in accordance with claim 6, wherein said angled body portion is positioned coextensively with a top portion of a respective film cooling hole such that said top portion of said film cooling hole and said angled body portion generally form a straight line.

9. A turbine assembly in accordance with claim 6, wherein said groove is disposed directly into a respective angled body portion such that cooling flow issuing from a respective cooling hole flows through said groove to a top portion of said winglet over said top surface of said tip portion and on to said tip cap.

10. A turbine assembly in accordance with claim 6, wherein the relative angle between said winglet and said film holes is between about −15 to +15 degrees.

11. A turbine assembly in accordance with claim 6, wherein said winglet edge is rounded.

12. A turbine assembly in accordance with claim 6, wherein said film cooling holes are contained within said winglet.

13. A turbine assembly in accordance with claim 1, wherein said grooves are cast features of said blade tip.

14. A turbine assembly in accordance with claim 1, wherein said grooves are machined into said blade tip after casting thereof.

15. A turbine assembly in accordance with claim 1, wherein said grooves are formed by laser drilling said blade tip after casting thereof.

16. A turbine assembly in accordance with claim 1, wherein said tip further includes a squealer tip.

17. A turbine assembly in accordance with claim 16, wherein said squealer tip is a single-tooth squealer.

18. A turbine assembly in accordance with claim 17, wherein said tip has a single-tooth squealer located approximately along a mean chordline of said blade tip section.

19. A turbine blade comprising: an airfoil having a pressure sidewall, a suction sidewall and a tip portion having a tip cap; a plurality of blade tip cooling holes disposed within at least one of said pressure sidewall and said suction sidewall of said airfoil adjacent to said tip portion; and at least one cooling groove disposed within at least one of said pressure sidewall and said suction sidewall of said airfoil connecting at least one of said blade tip cooling holes with a top portion of said tip so as to transition cooling flow from said cooling holes to said tip portion; wherein said grooves are multiple-channel cooling grooves.

20. A turbine blade in accordance with claim 19, wherein said blade tip film cooling holes are angled with respect to said airfoil.

21. A turbine blade in accordance with claim 19, wherein said blade tip film cooling holes are angled in the range between about 20° to about 70° with respect to the surface of said airfoil.

22. A turbine blade in accordance with claim 19, wherein said cooling grooves are disposed so as to have a substantially constant width from said film cooling holes to said tip portion.

23. A turbine blade in accordance with claim 19, wherein said grooves are fan-type cooling grooves.

24. A turbine blade in accordance with claim 19, further comprising a pressure side winglet disposed upon an upper portion of said airfoil, said winglet having a top portion contiguous with said top portion of said tip and an angled body portion.

25. A turbine blade in accordance with claim 24, wherein said angled body portion is angled at substantially the same angle as said film cooling holes.

26. A turbine blade in accordance with claim 24, wherein said angled body portion is positioned coextensively with a top portion of a respective film cooling hole such that said top portion of said film cooling hole and said angled body portion generally form a straight line.

27. A turbine blade in accordance with claim 24, wherein said groove is disposed directly into a respective angled body portion such that cooling flow issuing from a respective cooling hole flows through said groove to a top portion of said winglet over said top surface of said tip portion and on to said tip cap.

28. A turbine blade in accordance with claim 24, wherein the relative angle between said winglet and said film holes is between about −15 to +15 degrees.

29. A turbine blade in accordance with claim 24, wherein said winglet edge is rounded.

30. A turbine blade in accordance with claim 24, wherein said film cooling holes are contained within said winglet.

31. A turbine blade in accordance with claim 19, wherein said grooves are cast features of said blade tip.

32. A turbine blade in accordance with claim 19, wherein said grooves are machined into said blade tip after casting thereof.

33. A turbine blade in accordance with claim 19, wherein said grooves are formed by laser drilling said blade tip after casting thereof.

34. A turbine blade in accordance with claim 19, wherein said tip further includes a squealer tip.

35. A turbine blade in accordance with claims 34, wherein said squealer tip is a single-tooth squealer.

36. A turbine blade in accordance with claim 35, wherein said tip has a single-tooth squealer located approximately along a mean chordline of said blade tip section.

* * * * *